United States Patent [19]

Fibus

[11] 4,118,085

[45] Oct. 3, 1978

[54] WALL MOUNTED TOOL CABINET

[75] Inventor: C. Kenneth Fibus, Youngstown, Ohio

[73] Assignee: The Steel City Corporation, Youngstown, Ohio

[21] Appl. No.: 805,827

[22] Filed: Jun. 13, 1977

[51] Int. Cl.[2] ..... A47F 5/08

[52] U.S. Cl. ..... 312/245; 312/324; 312/199; 312/DIG. 33

[58] Field of Search ..... 312/245, 324, DIG. 33, 312/199, 138 R, 138 A; 108/1; 248/220.3

[56] References Cited

U.S. PATENT DOCUMENTS

| | | | |
|---|---|---|---|
| 244,818 | 7/1881 | McLean | 312/199 |
| 304,914 | 9/1884 | Dickson | 312/199 |
| 2,115,947 | 5/1938 | Ellison | 312/197 |
| 2,589,370 | 3/1952 | Grennan | 312/200 |
| 2,598,814 | 6/1952 | McAfee | 312/324 |
| 2,635,031 | 4/1953 | Erhardt | 312/199 |
| 3,135,569 | 6/1964 | Dereng | 312/324 |
| 3,306,689 | 2/1967 | Isaacson et al. | 312/199 |
| 3,556,023 | 1/1971 | Marschak | 248/220.3 |
| 3,754,806 | 8/1973 | Nakagawa | 312/245 |
| 4,003,610 | 1/1977 | Main | 312/324 |

FOREIGN PATENT DOCUMENTS

| | | | |
|---|---|---|---|
| 800,353 | 12/1968 | Canada | 312/307 |
| 447,075 | 3/1968 | Switzerland | 312/DIG. 33 |
| 764,061 | 12/1956 | United Kingdom | 312/DIG. 33 |

*Primary Examiner*—Victor N. Sakran
*Attorney, Agent, or Firm*—Webster B. Harpman

[57] ABSTRACT

A wall mounted tool cabinet easily assembled from a kit of parts comprises three units hinged to one another to form a complete enclosure with each unit formed of four frame sections and a section of pegboard material. Hooks detachably engaged in the pegboard material in each of the units serve to position tools therein to present the tools in side by side array when the units are opened.

4 Claims, 3 Drawing Figures

WALL MOUNTED TOOL CABINET

BACKGROUND OF THE INVENTION (1) Field of the Invention

This invention relates to tool cabinets such as may be mounted on the wall and in which tools, such as carpenter tools and the like, may be conveniently positioned for ready access.

(2) Description of the Prior Art

Tool cabinents have been heretofore proposed as may be seen for example in U.S. Pat. No. 2,589,370 wherein a wall mounted tool box is disclosed and in U.S. Pat. No. 516,005 there is a back panel with a pair of cabinets hinged to its opposite sides and U.S. Pat. No. 2,115,947 discloses a central cabinet on a base and includes a pair of cabinets hinged thereto and movable outwardly and away therefrom.

The present invention forms three cabinet-like units of molded plastic frame sections arranged to receive and retain sections of pegboard material such as perforated hardboard or the like, when assembled and includes integral hinge forming configurations on some of the frame sections. The arrangement and configuration of the frame sections and their assembly with the sections of pegboard to form the cabinet enclosure of each of the units is not disclosed in or suggested by any of the aforesaid prior art patents. The tool box of U.S. Pat. No. 2,589,370 is a box and lid construction of conventional structure. The combination furniture of U.S. Pat. No. 516,005 is conventional wood cabinetry and the same is true of the disclosure of U.S. Pat. No. 2,115,947. It would not be obvious to one skilled in the art having these patents before him to produce the wall mounted tool cabinet of the present invention which uses only multiples of five molded plastic parts and rectangular sections of perforated hardboard or the like.

SUMMARY OF THE INVENTION

A wall mounted tool cabinet comprises a first unit preferably rectangular with hinge configurations on its outermost corners. The cabinet is shallow and the hinge configurations hingedly support a pair of second units which together form a closure for the first unit. Each of the three units are formed of molded plastic frame members joined at their corners and each arranged to engage and hold a section of hardboard, pegboard or the like. Hooks engaged on the pegboard portions of the cabinets conveniently support tools, all of which are readily visible when the second units are swung open to positions on either side of the first unit. The three cabinet units may be easily assembled and joined to one another by hinge pins inserted in the preformed hinge configurations.

DESCRIPTION OF THE PREFERRED EMBODIMENT

Figure 1:
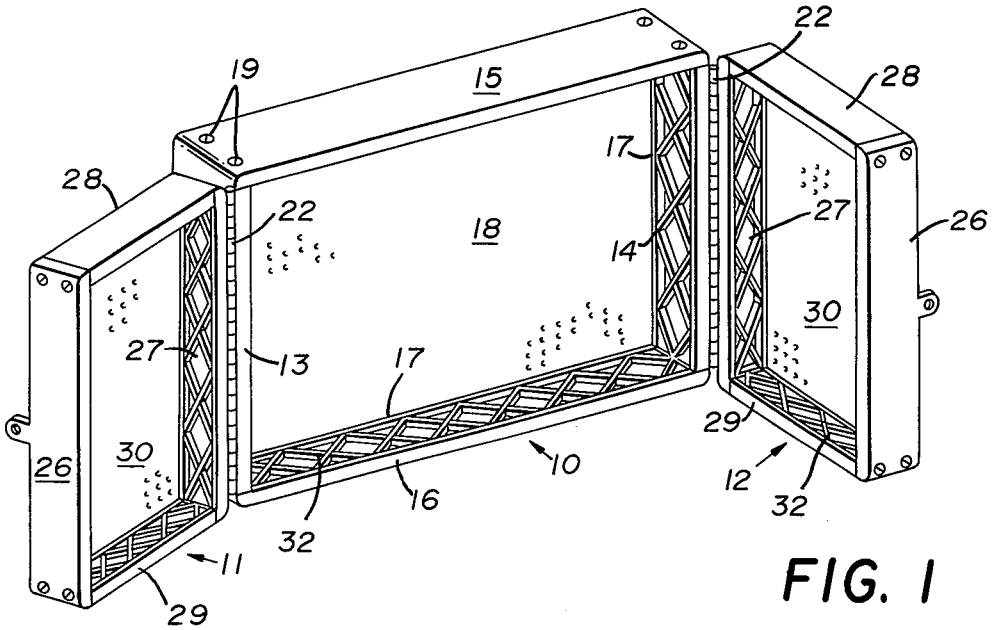
FIG. 1 is a perspective view of the wall mounted tool cabinet.

By referring to the drawings and FIG. 1 in particular, it will be seen that a wall mounted tool cabinet has been disclosed which comprises a first unit 10 and a pair of second units 11 and 12 hinged thereto at the outermost corners of the first unit 10. The first unit 10 is formed of a pair of oppositely disposed molded plastic frame members 13 and 14 respectively and a pair of horizontally disposed elongated molded plastic frame members 15 and 16 respectively. Each of the molded plastic frame members 13, 14, 15 and 16 has an elongated slot 17 therein as may be best seen by referring to FIG. 3 of the drawings.

Figure 3:
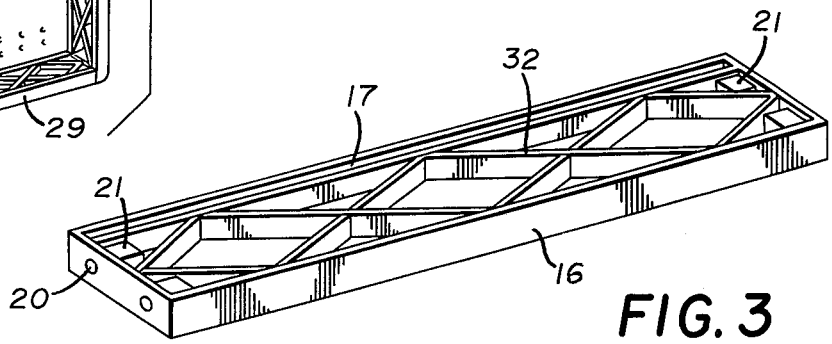
FIG. 3 is an enlarged perspective view of one of the frame members seen in FIGS. 1 and 2 of the drawings.

Still referring to FIG. 1 of the drawings, it will be seen that when the molded plastic frame members 13, 14, 15 and 16 are positioned around a rectangular section of pegboard 18 or hardboard and assembled as shown in FIG. 1, a first cabinet unit is defined including the back wall formed by the pegboard 18 and the side walls and top and bottom walls formed by the molded plastic frame units 13, 14, 15 and 16 respectively. The molded plastic frame units are assembled to one another by self-tapping screws 19 positioned through openings in the ends of the frame members 15 and 16 so as to engage openings 20 extending into bosses 21 in the adjacent ends of the frame members 13 and 14 as best seen in FIG. 3 of the drawings.

Figure 2:
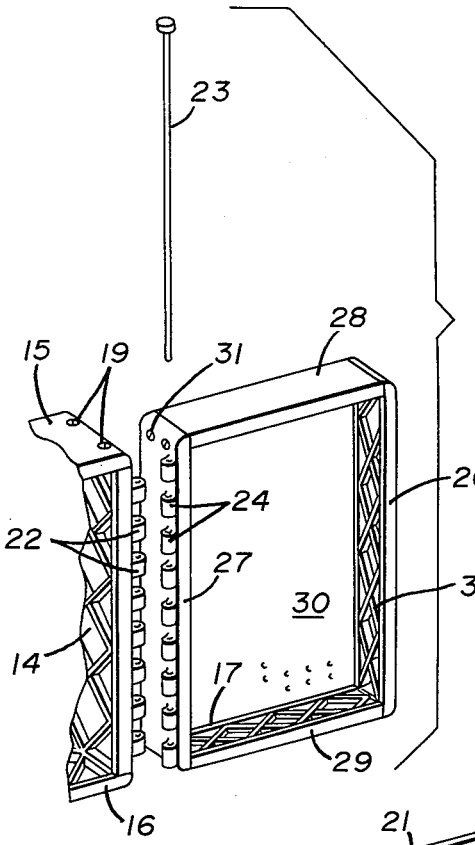
FIG. 2 is an exploded perspective view with parts broken away showing the hinge configurations and hinge pin of the cabinet seen in FIG. 1.

The frame members 13 and 14 are provided with hinge configurations 22 on their outermost front corners through which hinge pins 23 may be positioned to simultaneously engage staggered secondary hinge configurations 24 on the front corners of the second units 11 and 12. The hinge configurations and the hinge pin may best be seen in the exploded view comprising FIG. 2 of the drawings.

By referring again to FIG. 1 of the drawings, it will be seen that the second cabinet units 11 and 12 each comprise a pair of vertically positioned frame members 26 and 27 respectively and horizontally disposed top and bottom members 28 and 29 respectively. The molded plastic frame members 26, 27, 28 and 29 are formed with the same grooves 17 therein as the molded plastic frame units hereinbefore described, so that when assembled around a piece of pegboard 30 they will hold the same in desired position. Self-tapping screws 31 positioned through openings in the ends of the frame members 27 engage openings in bosses in the frame members 28 and 29 to secure the assembly. By referring to all of the Figures of the drawings, it will be seen that the molded plastic frame members 13, 14, 15, 16, 26, 27, 28 and 29 are all formed with a criss cross molded integral reinforcing grid structure 32 which in addition to providing structural strength to the frame members and holding the same against twisting or warping, provides a plurality of convenient receptacles in the lower horizontal frame portions of each of the cabinet units in which nuts, bolts, screws, nails and other fasteners may be conveniently positioned.

It will thus be seen that a wall mounted tool cabinet has been disclosed which can be easily assembled from a relatively few parts, several of which are identical, and that the assembled tool cabinet may be mounted upon a wall, as for instance over a work bench, where the second units can be moved to closed position to completely enclose tools positioned in the three unit cabinet.

Although but one embodiment of the present invention has been illustrated and described, it will be apparent to those skilled in the art that various changes or modifications may be made therein without departing from the spirit of the invention.

Having thus described my invention what I claim is:

1. A wall mounted tool cabinet comprising three units, said units each having a width dimension with the width of one of said units being double the width of the outer two, each unit having a frame, said frames each including top, bottom and side molded plastic members each of which members has a peripheral flange and a continuous channel therein adjacent one edge thereof, said frame members being arranged at right angles with respect to a wall, a flat rectangular panel positioned in each of said frames with its peripheral edges engaged in said continuous channels, each of said frames comprising four molded plastic frame members abutting one another at their ends, means securing said frame members to one another with said frame members being positioned about said flat rectangular panel so as to continuously engage and cage said panel in said continuous channel, integral hinge configurations on each of said units for mutual movable engagement and arranged so that said two of said units can move into covering relation with said one double width unit to form closures therefor, said bottom frame members each including a criss-cross molded integral reinforcing grid structure with the grids thereof defining a plurality of receptacles of each unit in which items, such as fasteners and the like, may be stored.

2. The wall mounted tool cabinet set forth in claim 1 and wherein said panel is a pegboard and hooks are movably engaged in said pegboard for supporting tools in said cabinet.

3. The wall mounted tool cabinet of claim 1 and wherein the hinge configurations are arranged to receive a pin and a hinge pin is engaged therein.

4. The wall mounted tool cabinet set forth in claim 1 and wherein each of the four molded plastic frame members is an elongated wide thin section of material with a continuous peripheral flange.

* * * * *